United States Patent [19]

Artho et al.

[11] 3,987,800

[45] Oct. 26, 1976

[54] SMOKABLE PRODUCT WITH MEERSCHAUM PARTICLES

[75] Inventors: Antoine Artho, Boncourt, Switzerland; Monique Béringer, Saint Louis, Frankreich, France; Paul Buchman, Basel; Robert Koch, Porrentruy, both of Switzerland

[73] Assignee: Tamag Basel AG, Switzerland

[22] Filed: July 2, 1974

[21] Appl. No.: 485,136

[30] Foreign Application Priority Data

July 24, 1973 Luxemburg ..... 68080

[52] U.S. Cl. ..... 131/15 R

[51] Int. Cl.[2] ..... A24D 1/02

[58] Field of Search ..... 131/2, 15, 17, 140–144, 131/261–267, 15 R; 162/137

[56] References Cited

UNITED STATES PATENTS

| | | | |
|---|---|---|---|
| 2,738,791 | 3/1956 | Schur et al. | 131/15 |
| 2,755,207 | 7/1956 | Frankenburg | 131/15 R |
| 3,608,560 | 9/1971 | Briskin et al. | 131/2 |
| 3,744,496 | 7/1973 | McCarty et al. | 131/15 R X |

FOREIGN PATENTS OR APPLICATIONS

| | | | |
|---|---|---|---|
| 276,194 | 11/1969 | Austria | 131/267 |

*Primary Examiner*—Robert W. Michell
*Assistant Examiner*—J. Millin
*Attorney, Agent, or Firm*—Wenderoth, Lind & Ponack

[57] ABSTRACT

The present invention relates to a smokable product such as cigars, cigarettes and the like with a paper cover, having meerschaum particles as an absorbant, characterized by the fact that the paper is admixed with the meerschaum particles which particles have a diameter of 100 mm or less. The inventive smokable products exhibit selective absorption of certain injurious smoke components.

3 Claims, No Drawings

SMOKABLE PRODUCT WITH MEERSCHAUM PARTICLES

The invention relates to smokable products such as cigars, cigarettes and the like with paper cover and having meerschaum particles as adsorbent. Regarding the cover it might be a question of cigarette paper, outer leaf of cigars made of paper, and the like.

A filter-tipped cigarette is known, the filter of which has a chamber which is filled with a granulate of breccia-like porous magnesium silicate and permeated by the main smoke stream sucked in by the smoker and hence with a noticeable selective action adsorbs the polar smoke components — and these are predominantly injurious to health — but on the other hand permits the predominantly polar non-injurious or less injurious to health aromatic smoke components to pass.

It is an objective of the invention to increase this favorable adsorption effect.

The invention is characterised by the feature in that the paper is permeated with meerschaum particles of 100 $\mu$ and smaller in diameter. Whilst in a known cigarette the adsorbing substance could be effective only over a short distance of the filter chamber, the meerschaum particles in accordance with the invention may be effective over the whole distance from the incandescent zone to the mouth end, for example, of the cigarette. Independently thereof the required adsorption of the harmful polar substances is also promoted by the fact that these may come into contact with the meerschaum particles already at the moment in which under the influence of the heat effect of the incandescent zone or that of the main smoke stream passing through. This applies particularly to the harmful substances arising from smouldering paper. Of note is also the fact that the harmful substances contained in the smoke not drawn in by the smoker but emanating directly from the incandescent zone are at least partly adsorbed by the meerschaum particles contained in the incandescent zone, whereby the health of the passive smokers, hence those who inhale the secondary stream smoke in a closed space, is protected. A corresponding effect is not obtainable with a filter-tip, because the latter influences only the main stream smoke.

Meerschaum in question is a magnesium silicate hydrate, which is known as mineral by the name Sepiolith and has a large adsorption area with a strong adsorption affinity for substances having an electric molecular structure, predominantly having smoke components harmful to health. For substances which like most harmless aromatic substances of the smoke are not polar, the adsorption affinity of the meerschaum is considerably lower.

Meerschaum in connection with the invention is also particularly suitable because in contrast to, for example, active carbon, it does not decompose in the incandescent zone giving off harmful gases. The main proportion of adsorbed harmful substances on the meerschaum particles in the incandescent zone, either remain adsorbed or they are decomposed and thus are converted into decomposition products which are either harmless or are substantially less harmful than the starting products.

The particles preferably consist of breccia-like porous meerschaum. Breccia-like meerschaum is a variety of the non-breccia-like meerschaum and is available cheaply in large quantities. For instance, breccia-like porous meerschaum is found in the Madrid tertiary basin. Breccia-like porous meerschaum does not disintegrate in boiling hydrochloric acid 1:1, but at the most is soluble to two thirds therein and during heating to 300° Centigrade suffers a loss of weight of 15 percent by weight at the most and has a magnesium contents of at least 5 percent by weight — in relation to the dry substance. This breccia-like porous meerschaum cracks non-breccia-like meerschaum due to its greater hardness. The density of breccia-like porous meerschaum, measured at the air-dried section, is approximately 1.2 grammes per cubic centimeter. The density of non-breccia-like meerschaum is, measured under the same conditions, approximately 0.5 – 0.6 grammes per cubic centimeter. Breccia-like porous meerschaum has a surface of at least 100 square meters per gramme. If the meerschaum material is finely powdered and the density determined in the gas pycnometer, then with breccia-like porous meerschaum and with non-breccia-like meerschaum the same values, namely 1.8 to 2.0 grammes per cubic centimeter are obtained. Breccia-like porous meerschaum consists of round to angular brownish-white domains which show minor differences in colour and are separated by a white matrix, so that they are already recognizable by the naked eye. At blows with a hammer this stone cracks particularly at the surface of these domains.

Breccia-like porous meerschaum is processed into granulate for cigarette filters. When granulating the granulate is produced mainly from the harder domains while the matrix material lying in between turns to fine dust and is no longer useful as granulate. This material useless as granulate for structural reasons, has an excellent adsorbing quality with considerable selective effect in favour of polar harmful substances and as it is furthermore available at low costs as waste from the granulate production it will be employed in accordance with a preferential development of the invention. This development is marked by the fact that the finer waste, resulting from granulating the breccia-like porous meerschaum to a grain size of 0.1 to 5 millimeter diameter, will be used as adsorbing substance and might be ground even finer for this purpose.

Preferably the medial particle diameter of at least three quarters of the meerschaum weight used is as large as half the value plus/minus 30 percent of the thickness of the paper which is mixed with these meerschaum particles. The thickness of the cigarette paper is normally in an order of magnitude of between 20 and 30 $\mu$. For embedding meerschaum into cigarette paper of 30 $\mu$ it is advisable to use an average diameter of about 10 to 20 $\mu$.

If the medial particle diameter is as stated, then the meerschaum particles with which the paper is mixed do not protract specially, but are nevertheless exposed with a large proportion of their surface, or only covered by a very thin layer through which the harmful substances may easily be diffused.

If the admixing rate, hence the weight ratio of the meerschaum particles mixed to the paper is increased relative to the weight of the paper concerned, then also the adsorption rate of the harmful substances is increased, and hence at smaller admixture rates over proportional. The rate of adsorption is the ratio of adsorbed quantity of harmful substance relative to the overall quantity of the harmful substances present. From a certain optimal admixture rate on, the value of which depends upon manifold secondary conditions — quality of the meerschaum, method of inserting or addition of the meerschaum and the like — and which may be found by testing in an individual case, the adsorption rate, however, increases only to a small extent. Further increase of the admixture rate of the meerschaum beyond this optimal value is hence not justifiable by the increase of adsorption obtainable therewith alone, it will be necessary to increase it only beyond this optimal value if the property of the meerschaum as filler substance is considered important. If this is not so, then it is recommended to retain the maximum admixture rate and a corresponding embodiment of the invention is characterised by the feature that the meerschaum particles are distributed over the smouldering parts of the paper with an admixture rate which is so great that a further increase of the admixture rate causes a less than proportional increase of the average adsorption rate of the harmful substances carbon monoxide, acrolein, nitrile, phenol and the homologous and polycyclic aromatic hydrocarbons thereof, a reduction on the other hand of the admixture rate causes at least reduction proportional thereto of the said average adsorption rate. Preferred is an admixture rate relative to the dry substance of 14 to 20 percent.

A preferred process for producing paper with embedded meerschaum particles is characterised by the feature that the meerschaum particles are stirred into a pulp prepared for producing paper, before this is formed and set by drying to form smoulderable parts.

A preferred process for producing paper with added meerschaum particles is characterised by the feature that a pulp prepared for producing paper is formed to the paper and dried partly and that the meerschaum particles are scattered and/or rolled onto this still soft paper, so that they are moistened on the surface by the residual moisture of the pulp and that then the paper is set by finish-drying.

EXAMPLE 1

For producing cigarette paper, 150 grammes to 1 kg pulp breccia-like porous meerschaum ground to an average diameter of 15 $\mu$ are stirred into the paper pulp, before the pulp is processed into cigarette paper having a thickness of 30 $\mu$.

EXAMPLE 2

1000 grammes of cellulose are disperged in 50 liters water and ground in wet condition. 140 grammes of meerschaum powder is stirred into this homogeneous cellulose pulp. The meerschaum powder is the finely pulverized waste resulting from producing granulate of breccia-like porous meerschaum and which is finely ground to an average diameter of 10 $\mu$. By adding alum $(Al_2 SO_4)_3 \cdot 18 H_2O$ the pulp is set to pH 5 and will then be formed by a paper machine into sheets weighing 70 grammes per square meter and having a thickness of 30 $\mu$.

EXAMPLE 3

1 kg of paper pulp is spread to a thickness of 30 $\mu$ and on this paper, before it is completely dry, 200 grammes of breccia-like porous meerschaum finely ground to an average grain size of 20 $\mu$, will be sprinkled and rolled and then the paper will be finish-dried by extracting the excessive moisture.

EXAMPLE 4

As example 2, however, instead of 140 grammes of meerschaum 250 grammes will be added.

All examples feature a very good adsorption of harmful substance. The consistence of the paper is good when applying examples 1 to 3, with example 4 it is imperfect.

We claim:

1. In a smokable tobacco product having a paper cover and having meerschaum particles as an adsorbent, the improvement which comprises employing as the paper cover, a paper admixed with meerschaum particles having a diameter of 100 microns or less, said meerschaum particles consisting of breccia-like porous meerschaum which does not disintegrate in boiling nitric acid 1:1 but is soluble therein at the most ⅔ and which during heating to 300° C has a weight loss of at most 15% by weight and which has a magnesium content of at least 5% by weight based on the dry substance, which breccia-like porous meerschaum on account of its greater hardness scratches non-breccia like meerschaum and the density thereof, measured at the air-dried section, is about 1.2 g/cm$^3$ compared with non-breccia-like meerschaum, the density of which measured under the same conditions, is between about 0.5 and 0.6 g/cm$^2$ and which breccia-like porous meerschaum has a surface of at least 100 m$^2$/g, said breccia-like porous meerschaum consisting essentially of the fine waste which results from granulating breccia-like porous meerschaum to obtain a range of 0.1 to 5 millimeters diameter, said breccia-like porous meerschaum being present in said paper in an amount effective to selectively adsorb polar harmful substances in tobacco smoke.

2. A product according to claim 1, wherein the medial particle diameter of at least three quarters of the meerschaum weight used is as large as half the average value plus/minus 30 percent of the thickness of the paper which is mixed with these meerschaum particles.

3. A product according to claim 1 wherein the meerschaum particles are distributed throughout the paper in an amount such that a further increase causes a less than proportional increase of the average adsorption rate of the harmful substances carbon monoxide, acrolein, nitriles, phenol, and their homologs, and polycyclic aromatic hydrocarbons, on the other hand a reduction of the amount causes at least a reduction proportional thereto of the said average adsorption rate.

* * * * *